United States Patent [19]

Palley

[11] Patent Number: 4,565,408

[45] Date of Patent: Jan. 21, 1986

[54] PORTABLE HEAD SUPPORT FOR SLEEPING OR RESTING IN A SITTING POSITION

[76] Inventor: Maria Palley, 18 Dean St., Madison, N.J. 07940

[21] Appl. No.: 550,450

[22] Filed: Nov. 9, 1983

[51] Int. Cl.[4] ..... A47C 16/00; A47C 7/36

[52] U.S. Cl. ..... 297/393; 297/392

[58] Field of Search ..... 297/392, 393; 5/437; 128/75, 87 B; 248/118

[56] References Cited

U.S. PATENT DOCUMENTS

| | | | |
|---|---|---|---|
| 1,508,892 | 9/1924 | Mikalsen | 128/75 X |
| 2,102,069 | 12/1937 | Hanicke | 128/87 B |
| 2,642,864 | 6/1953 | Ward | 128/87 B |
| 3,283,755 | 11/1966 | Harden | 297/393 X |
| 4,413,619 | 11/1983 | Garth | 128/87 B X |

*Primary Examiner*—William E. Lyddane
*Assistant Examiner*—Peter R. Brown

[57] ABSTRACT

A portable device for human head support for sleeping or resting in a sitting position. The device is provided with a strip of flexible material, on which the lower surface of the user's face rests, the strip connected to two rigid cushioned supports in a manner of "hanging bridge", the supports resting on the collar bone—shoulder surface area. One or more flexible straps provide stability to the structure. One strap, embracing the nape of the user's neck is considered necessary for any embodiment of the present invention. Other embodiments with the straps, connecting the rigid supports provide additional stability.

5 Claims, 8 Drawing Figures

PORTABLE HEAD SUPPORT FOR SLEEPING OR RESTING IN A SITTING POSITION

BACKGROUND

1. Field of the Invention

The present invention relates generally to head supporting devices, more particularly to the devices intended to provide comfort of sleeping or resting in a sitting position in a partially reclined chair, especially for a passenger traveling in a plane, a bus, a train, a car, etc.

2. Description of the Prior Art

Head supporting devices are known in the prior art. Some of them provide head support by inserting a rigid construction between parts of the head and the torso. U.S. Pat. Nos. 689,097, 1,051,896, 1,589,900, 2,000,344, for example, belong to this category. All these structures, however, consist of too many parts, can not be folded and taken along conveniently on a trip.

Other devices engage the chair as a part of the supporting construction. To this category belong, for example, devices disclosed in U.S. Pat. Nos. 4,097,086, 4,285,081, 4,183,583, and 4,339,151. None of the existing types of head supports depend of the basic principle herein described.

SUMMARY OF THE INVENTION

Objects of the present invention are to provide a novel, portable, inexpensive, simple, and comfortable support for the human head, when the user rests or falls asleep in a sitting position, especially when on travel in a plane, bus, train, car, etc.

The objects of the invention are achieved by providing a device with a combination of flexible and rigid elements inserted between lower jaw-cheeks and collar bone-shoulders areas. The device consists of a strip of flexible material on which the lower jaw and cheeks rest, the strip, connected to two rigid cushioned supports in a manner of "hanging bridge", and one or more flexible straps. One of the straps binds the structure to the head, others designed to provide additional stability.

DESCRIPTION OF THE PREFERRED EMBODIMENTS

Figure 1:
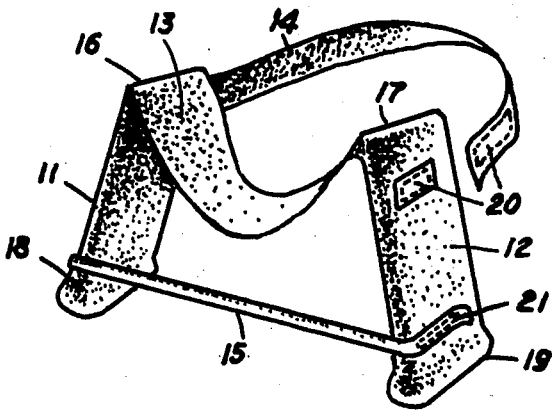
FIG. 1 illustrates a perspective view of a preferred embodiment of the present invention.
Figure 3:
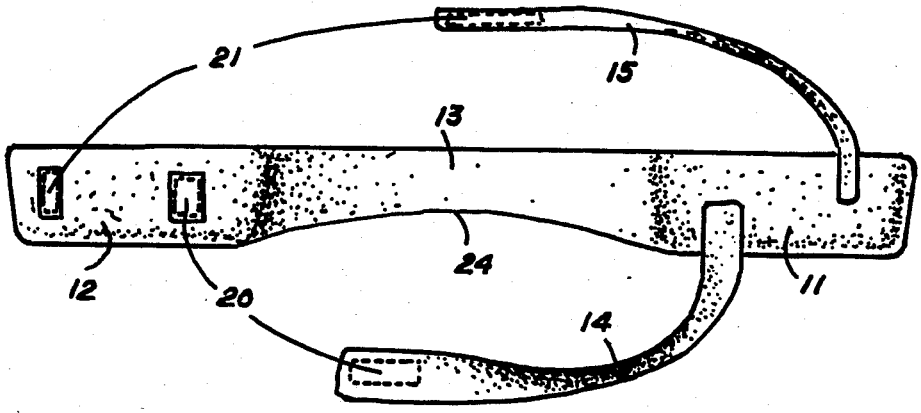
FIG. 3 illustrates a top view of the embodiment FIG. 1 in unfolded position.
Figure 4:
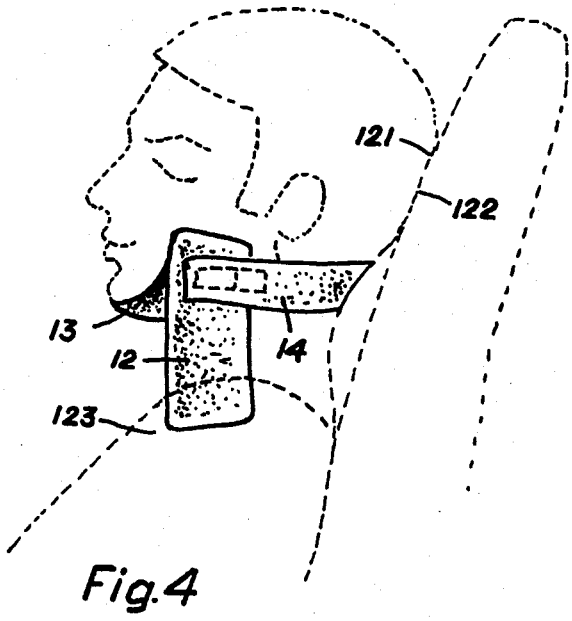
FIG. 4 illustrates a side view of the embodiment in use.

Referring to FIG. 1, there is illustrated a perspective view of a preferred embodiment of the present invention. Two rigid supports 11 and 12 with a strip of flexible material 13 in between, on which the lower jaw and cheeks can rest in a way shown in FIGS. 4, 5 and 6, create sort of "hanging bridge" structure. The strip 13 may have the internal edge concave, as seen in FIG. 3, to leave the space for the front surface of the user's neck. The supports 11 and 12 have the shape of generally, but not necessarily, flat rectangular plaques with upper 16, 17 and lower 18, 19 butt-ends, shaped and padded to reduce pressure on the cheeks and the collar bone-shoulders areas, respectively, that they contact. A flexible strap 14, connected permanently to the upper part of one of the supports (11), and with an adjustable fastener 20 to the another support (12), fixes the device with respect to the user's head, by embracing the lower occipital bone or the nape of the neck, as it is illustrated in FIG. 4, and provides exceptional stability to the structure. The strip 13 can be connected permanently to the both supports or with an adjustable fastener to the one of them to allow control of it's length, according to the size and preference of the individual user.

Figure 5:
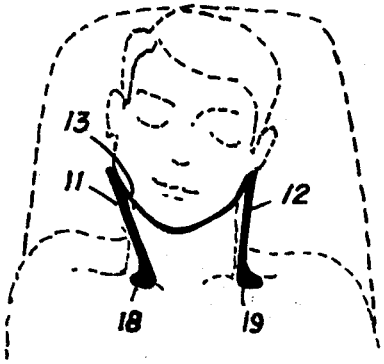
FIG. 5 and FIG. 6 illustrate a front view of the device in use.
Figure 6:
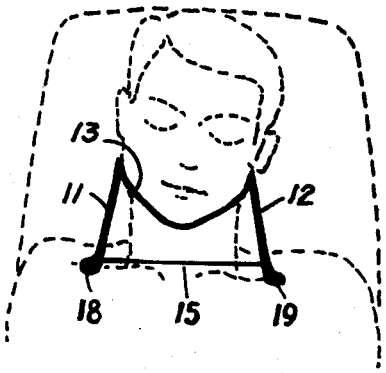

A strap 15, connecting lower parts of the supports 11 and 12, provides stability to the device, when the device is utilized, as shown in FIG. 6, i.e. when the distance between the lower butt-ends 18 and 19 of the supports is more, than distance between the upper butt-ends 16 and 17. However, this embodiment also provides remarkably stable head support, when the distance between the lower butt-ends is lower, then the distance between the upper butt-ends, as it is shown in FIG. 5. In this case the strap 15 can be ommited.

Figure 2:
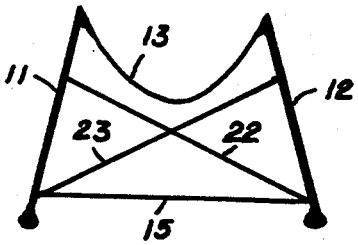
FIG. 2 illustrates a front view of another preferred embodiment.

Referring to FIG. 2, there is illustrated a front view of another preferred embodiment, where two additional straps 22, 23 connect the supports 11 and 12, so that one end is attached to one support on the level of the strap 15, the other end is attached to the second support somewhere closer to the upper butt-end. The combination of all the described straps gives a exceptional stability to the device.

Referring to FIG. 3, there is illustrated a top view of the preferred embodiment of FIG. 1, in a flat, unfolded position, where the concave edge 24 of the strip 13 can be seen.

Referring to FIG. 4, there is shown a side view of the preferred embodiment FIG. 1 in use. The device is used in combination with a tall back seat 122 in a bus, plain, train or in a car with a deep seat or a back head support, or with any surface behind, that provides a support for the back of the user's head 121. The lower jaw and cheeks rest on the strip 13, which, in turn, is supported by the plaques 11 and 12, and those plaques rest on the shoulder-collar bone area 123 of the user's torso, as is also shown in FIGS. 5 and 6. The whole structure is tied to the head with the strip 14.

Figure 8:
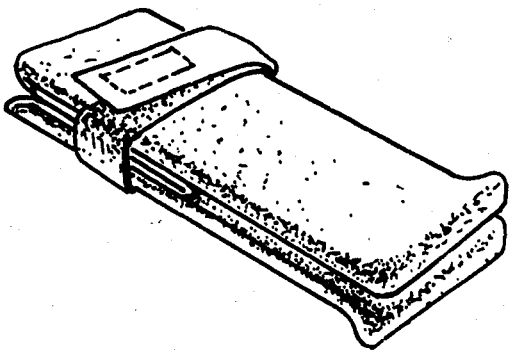
FIG. 8 illustrates the device when folded.

The "hanging bridge" structure with the strip 13 allows to distribute the pressure on the face from the rigid supports 11 and 12;

to position the supports under a sharp angle (close to the tangential position) to the cheeks, and thus to reduce concentrated forces from the supports, but at the same time to retain their stability;

to make the structure foldable, as it is shown in FIG. 8 and, thus portable.

Referring to FIGS. 5 and 6, there are shown two front views of the preferred embodiment in use. The user can adjust positions of the lower surfaces of the plaques 11 and 12 to his convenience. In all positions, when the plaques 11 and 12 are not set paralelly to each other, the device of the present invention provides remarkably stable support to the head, even when the muscles of the neck are completely relaxed. The support is stable against the disturbing forces of inertia during travellings. The device provides stable support also if for the comfort of sleeping the head is tilted aside.

Figure 7:
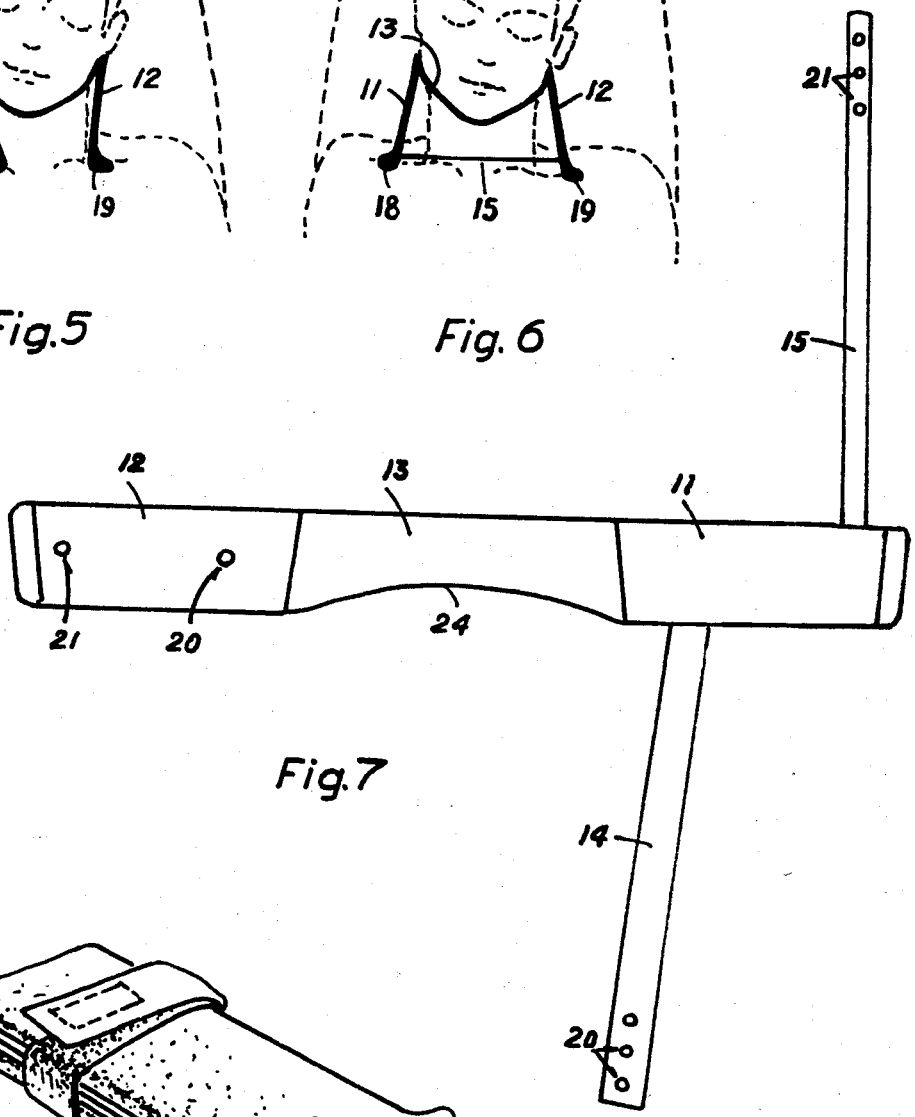
FIG. 7 illustrates a top view of the unfolded device, molded as one piece.

The basic construction of the device can be embodied in many ways, and by using different materials. Referring to FIG. 7, there is an example of one embodiment, where all structural elements of the device are molded from a plastic. Thin layers of the plastic produce the flexible strips 13, 14, 15; thicker layers produce the rigid supports 11 and 12. The supports 11 and 12 can be molded also as thin-wall elements with ribs or as "waffle" or similar structures in order to save material and reduce the weight. Cushioning effect of the supports ends can be achieved by a proper design, including the reduction of their rigidity through changing of the thickness and shape. The strip 13 can also be of variable thickness to control its rigidity for maximum comfort. The strips and supports can have molded-in fasteners. As an example, multiple holes 20, 21 on the straps 14, 15 and corresponding projections (FIG. 7) are designed to create the adjustable fasteners. Other fastening mechanisms in the spirit can be used.

The device can be also made by using a thin sheet of the plastic, fabric, strong paper, etc., from which the outline of the elements shown in FIG. 7 is cut out. Two plaques of a rigid material are glued or attached to the areas 11 and 12, thus creating the rigid supports 11 and 12 of the device. Pads of a soft foam or another material can be additionally glued or attached in any other way to the butt-ends 19 and 20 to create the cushioning effect. Regular adhesives or pressure sensitive adhesives can be used to fasten the straps 14 and 15 to the supporting plaques 11 and 12.

The methods of production, described above, give inexpensive, possibly disposable versions of the present invention. Such devices can be offered to the passengers of airplanes, trains, buses, etc. by the companies, or bought by the passengers for a single trip.

A version for repeated use can be made out of a fabric, soft plastic, or leather. The strip 13 and two sheaths for the supports 11 and 12 are cut out of the fabric or soft plastic and sewn as one piece. Two flat or ribboned plastic, wooden, metal, etc. plaques, padded at the lower and upper butt-ends with soft foam, are inserted inside sheaths 11 and 12, and the openings are closed with a fastener. The plaques can slide in the sheath, and thus the length of the strip 13 can be controlled. The strips 14 and 15 with one part of a fastener on one side and the corresponding part of the fastener on the other side are sewn to the sheaths of the supports 11 and 12 the way as seen in FIG. 3. VELCRO fastener, buttons, hooks, pressure sensitive adhesive, etc. are possible versions of the fasteners. The embodiment may be designed as machine washable. Additional washable or disposable sheath-cover can be provided with the device to cover the surface of the strip 13 that contacts the user's face.

It should be understood, that other forms of the applicant's invention may be had, all coming within the spirit of the invention and the scope of the following claims.

I claim:

1. A device for supporting the human head, comprising two elongate sheaths formed from flexible material and interconnected by a flexible chin supporting strap, a thin, elongate substantially rigid support plate received in each said sheath, and an additional flexible strap secured at each end to a respective elongate sheath to extend in a direction substantially normal to the elongate direction of each said sheath, whereby the device is positioned with the plates located on opposite sides of a user's neck and resting on the user's shoulder-collarbone area, the flexible chin supporting strap underlines and supports the chin of the user, and the additional flexible strap extends behind and embraces the neck to retain the device in chin supporting position.

2. The device of claim 1, wherein the additional flexible strap is secured at least at one end by releasable fastening means.

3. The device of claim 2, wherein said fastening means comprises interengaging hook and loop fasteners secured respectively to said one end of said additional strap and a respective sheath, thereby permitting the device to accommodate users of different sizes.

4. The device of claim 1, wherein said elongate support plates have rectangular shapes with pads on their upper and lower ends shaped to reduce pressure on the cheeks and the upper chest.

5. The device of claim 1, wherein the inner side of said chin supporting strip has a concave cutout corresponding to the human neck.

* * * * *